US008176886B2

(12) United States Patent
Lichtenwald

(10) Patent No.: US 8,176,886 B2
(45) Date of Patent: May 15, 2012

(54) CAMSHAFT ADJUSTING DEVICE

(75) Inventor: Viktor Lichtenwald, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 538 days.

(21) Appl. No.: 12/417,957

(22) Filed: Apr. 3, 2009

(65) Prior Publication Data

US 2009/0250029 A1 Oct. 8, 2009

(30) Foreign Application Priority Data

Apr. 5, 2008 (DE) ..... 10 2008 017 455

(51) Int. Cl.
*F01L 1/34* (2006.01)

(52) U.S. Cl. ..... 123/90.17; 123/90.15; 464/160

(58) Field of Classification Search ..... 123/90.15, 123/90.17; 464/1, 2, 160
See application file for complete search history.

(56) References Cited

U.S. PATENT DOCUMENTS 4,858,572 A * 8/1989 Shirai et al. ..... 123/90.12
6,651,600 B1 * 11/2003 Schafer et al. ..... 123/90.17
* cited by examiner

*Primary Examiner* — Ching Chang
(74) *Attorney, Agent, or Firm* — Lucas & Mercanti, LLP; Klaus P. Stoffel

(57) ABSTRACT

A camshaft adjusting device for an internal combustion engine of a motor vehicle. The camshaft adjusting device has a stator which is driven via a crankshaft of the internal combustion engine and a rotor which is connected in a rotationally fixed manner to the camshaft. The rotary angle position of the rotor can be varied with respect to the stator by way of a piston which can be displaced in the radial direction.

9 Claims, 1 Drawing Sheet

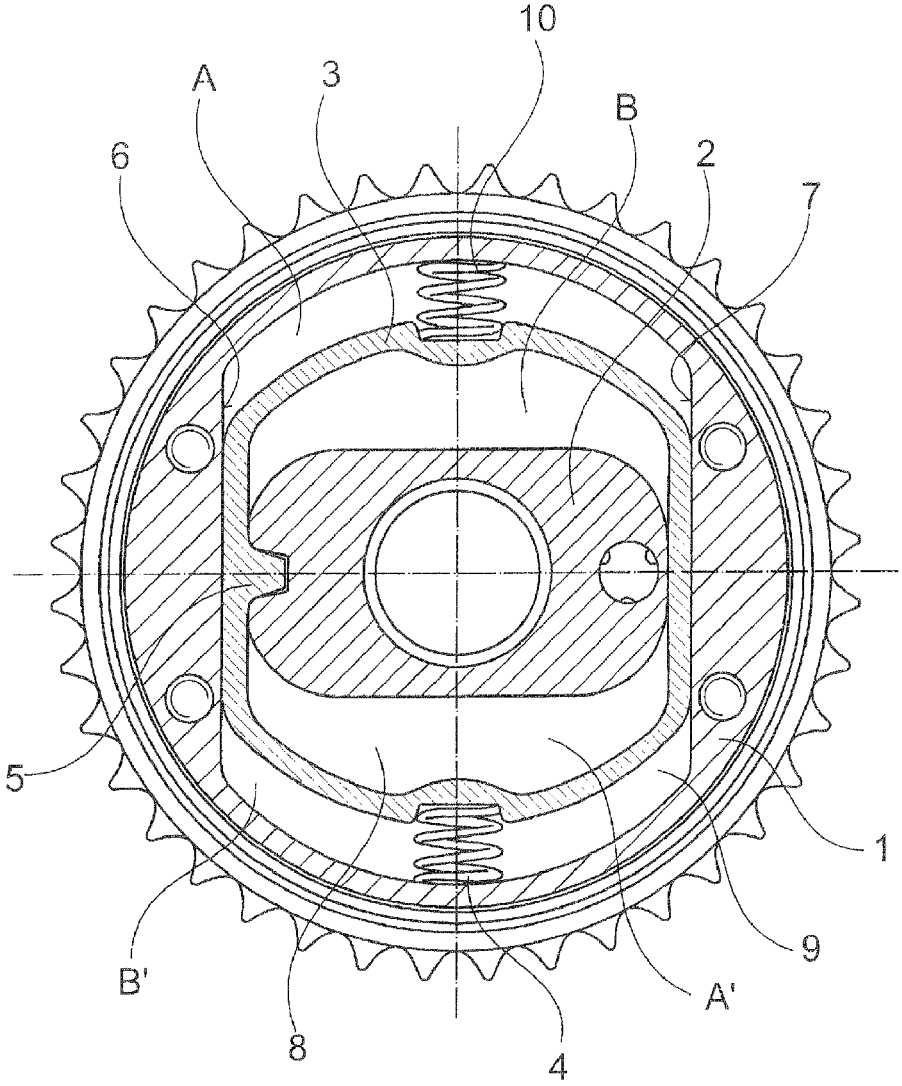
10
A
3
B
6
2
7
5
1
9
B'
A'
8
4

CAMSHAFT ADJUSTING DEVICE

This application claims the priority of DE 10 2008 017 455.6 filed Apr. 5, 2008, the priority of which is hereby claimed and incorporated by reference herein.

BACKGROUND OF THE INVENTION

The invention relates to a camshaft adjusting device.

Camshaft adjusting devices for internal combustion engines of motor vehicles having a stator which can be driven via a crankshaft of the internal combustion engine and having a rotor which is connected in a rotationally fixed manner to the camshaft are sufficiently well known in the prior art.

One embodiment of the camshaft adjusting devices is known, for example, from EP 0 806 550 A1. Said embodiment comprises the fact that the rotor has a rotary blade piston which divides a cavity in the stator into different working chambers. The working chambers have a pressure medium supply, via which the working chambers can be loaded with pressure medium, with the result that the rotor performs a rotational adjusting movement with respect to the stator.

Disadvantages of this embodiment are the comparatively complexly designed rotary piston, the high leakage losses, the increased frictional moments between the rotor and the stator, the increased requirement for installation space, and finally complex assembly mounting with the associated high costs. Furthermore, a high system pressure is required on account of the small surface area on which the pressure medium can act.

As an alternative, the rotor can also have an axial piston drive, the adjusting movement of which is converted via a helical toothing system, which is complicated in production, into a rotational movement of the rotor with respect to the stator. An apparatus of this type is known, for example, from DE 42 18 082 A1.

Disadvantages in this adjusting device are likewise the high number of individual parts and the associated high mounting costs.

SUMMARY OF THE INVENTION

It is an object of the invention to provide a camshaft adjuster which is to have as simple a construction as possible with as few individual parts as possible.

In order to achieve the object, it is proposed that the rotary angle position of the rotor can be varied with respect to the stator by way of a piston which can be displaced in the radial direction.

A camshaft adjuster is therefore provided which has a linear adjusting movement of the piston, which linear adjusting movement can be sealed simply, it being possible for the radially directed adjusting movement to be converted into a rotational adjusting movement of the rotor inexpensively without the use of a helical toothing system. Here, radial direction is understood generally as meaning every displacement direction which comprises a translatory component and in the process can also be combined with a rotational component to form an arcuate displacement movement. Here, the displacement path advantageously lies completely in a plane which is penetrated perpendicularly by the rotational axis of the adjuster.

Furthermore, the structural construction is further simplified by it being possible for the displacement movement of the piston to be turned into a rotational adjusting movement of the rotor by means of an engagement means which acts eccentrically on the rotor.

In order that the adjusting movement does not take place in an uncontrolled manner and the piston performs the restoring movement without additional aids, it is proposed that the piston is spring loaded with respect to the stator by at least one spring means. Here, the spring loading is designed in such a way that the piston is prestressed into a setpoint position, into which it is moved back again by the spring means after the adjusting movement has ended.

In order that the piston can be adjusted in both directions, it is proposed that the spring means comprise two or more springs which act counter to one another.

A further simplified construction of the camshaft adjuster results from the fact that the piston has a cavity, in which the rotor is arranged. As a result, the stator can be premounted with the piston and can subsequently be pushed onto the rotor.

Furthermore, the rotor can divide the cavity of the piston into two working chambers, with the result that one and the same piston with a simple construction can be used for the adjusting movement of the rotor in both directions.

Furthermore, it is proposed that the piston is arranged in a cavity of the stator and divides the cavity of the stator into at least two working chambers. The piston can therefore also perform an adjusting movement with respect to the stator in two directions.

A further preferred refinement of the invention comprises the fact that in each case one working chamber between the piston and the rotor and one working chamber between the piston and the stator have a common pressure medium supply. On the one hand, the advantage is therefore provided that the adjusting movement in one direction is carried out by the loading of two chambers with pressure medium, with the result that, even in the case of one of the chambers possibly being incapable of functioning, the adjusting movement is still ensured by the respective other chamber. On the other hand, despite the four working chambers, only two pressure medium supply lines are required. Furthermore, the surface area, on which the pressure medium can act, and therefore the pressure boost are increased as a result of this embodiment. As a consequence, the adjuster can be operated at lower system pressures in a functionally reliable manner and at high adjusting speeds.

The piston can preferably be arranged in a cavity of the stator, and the cavity can have two guide faces which lie opposite one another, are arranged parallel to one another and on which the piston is guided. This results in a structurally simply configured guidance means of the piston, which guidance means can also be produced and finally machined in a common process.

BRIEF DESCRIPTION OF THE DRAWINGS

In the following text, the invention will be explained in greater detail using one preferred exemplary embodiment. In the single FIGURE, in detail:

The FIGURE shows a camshaft adjusting device having a stator, a rotor and a piston which is guided in the stator in the radial direction.

DETAILED DESCRIPTION OF THE INVENTION

In the FIGURE, a camshaft adjusting device according to the invention can be seen, in which a stator 1 is provided which is driven via a crankshaft (not shown) of an internal combustion engine. Furthermore, a rotor 2 can be seen which is connected in a rotationally fixed manner to a camshaft (not shown) for adjusting the opening and closing times of the gas exchange valves of the internal combustion engine. A cavity 9 is provided in the stator 1, which cavity 9 is delimited laterally by the guide faces 6 and 7 which are arranged parallel to one another. A piston 3 is provided in the cavity 9 of the stator 1, which piston 3 likewise has a cavity 8 and in which the rotor 2 is arranged. The rotor 2 divides the cavity 8 of the piston 3 into the working chambers A' and B, and the piston 3 in turn divides the cavity 9 of the stator into the working chambers A and B'. The piston 3 is prestressed into a setpoint position with respect to the stator 1 by means of the spring means 4 and 10 which are configured as spiral springs. Furthermore, the piston 3 is connected to the rotor 2 by means of an engagement means 5 which engages eccentrically into said rotor 2. If the stator 1 is then set into rotation in a known manner by the internal combustion engine via the crankshaft, the rotational movement is transmitted via the guide faces 6 and 7 to the piston 3 which finally transmits the rotation via the engagement means 5 to the rotor 2. If the rotary angle of the rotor 2 and therefore of the camshaft is to be changed with respect to the stator 1, the working chambers A and A', for example, are loaded jointly with pressure, as a result of which said working chambers A and A' increase in size and move the piston 3 downward in the position shown in the FIGURE. It is important here that the pressure loaded working chambers A and A' load the piston 3 with a force in the same direction. This is achieved by the fact that the working chamber A is arranged on the outside between the piston 3 and the stator 1, while the respectively other working chamber A' is arranged on the other side of the rotor 2 between the rotor 2 and the piston 3 within the piston 3. During its linear displacement, the piston 3 rotates the rotor 2 counter-clockwise by way of the engagement means 5 which acts eccentrically on the rotor 2. For the adjusting movement of the rotor 2 by way of the linearly moved piston 3, both the stator 1 and the rotor 2 can be considered to be radially stationary, with the result that the loading of the working chambers A and A' with pressure medium leads necessarily to a linear adjusting movement of the piston 3. For the duration of the adjusting movement, the spring means 4 is compressed and the spring means 10 is stretched, with the result that the piston 3 is moved back into the initial position when the pressure loading of the working chambers A and A' is ended. The opposed adjusting movement of the rotor 2 is achieved analogously to the above-described movement sequence by loading the working chambers B and B' with pressure.

The invention claimed is:

1. A camshaft adjusting device for an internal combustion engine of a motor vehicle having the following components:
   - a stator which is driven via a crankshaft of the internal combustion engine;
   - a rotor which is connected in a rotationally fixed manner to the camshaft; and
   - a piston that has a cavity in which the rotor is arranged,
   - wherein a rotary angle position of the rotor is varied with respect to the stator by way of the piston which is displaced in a radial direction.

2. The camshaft adjusting device according to claim 1, wherein displacement movement of the piston is turned into a rotational adjusting movement of the rotor by way of an engagement means which acts eccentrically on the rotor.

3. The camshaft adjusting device according to claim 1, wherein the piston is spring loaded with respect to the stator by at least one spring means.

4. The camshaft adjusting device according to claim 3, wherein the spring means comprise two or more springs which act counter to one another.

5. The camshaft adjusting device according to claim 1, wherein the rotor divides the cavity of the piston into two working chambers.

6. The camshaft adjusting device according to claim 5, wherein one working chamber between the piston and the rotor and one working chamber between the piston and the stator have a common pressure medium supply.

7. The camshaft adjusting device according to claim 1, wherein the piston is arranged in a cavity of the stator and divides the cavity of the stator into at least two working chambers.

8. The camshaft adjusting device according to claim 7, wherein one working chamber between the piston and the rotor and one working chamber between the piston and the stator have a common pressure medium supply.

9. The camshaft adjusting device according to claim 1, wherein the piston is arranged in a cavity of the stator, and the cavity has two guide faces which lie opposite one another, are arranged parallel to one another and on which the piston is guided.

* * * * *